US008782985B2

(12) United States Patent
Gulbrandsen et al.

(10) Patent No.: US 8,782,985 B2
(45) Date of Patent: Jul. 22, 2014

(54) SPLICE CLIP FOR CEILING GRID SYSTEMS

(71) Applicant: USG Interiors, LLC, Chicago, IL (US)

(72) Inventors: Peder Gulbrandsen, Aurora, IL (US); Mark Miklosz, Western Springs, IL (US); Stephen Oshgan, Des Plaines, IL (US); Joe Wascow, Vernon Hills, IL (US); Nicholas Jackson, Carol Stream, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/776,818

(22) Filed: Feb. 26, 2013

(65) Prior Publication Data

US 2013/0227907 A1 Sep. 5, 2013

Related U.S. Application Data

(60) Provisional application No. 61/605,468, filed on Mar. 1, 2012.

(51) Int. Cl.
*E04B 2/00* (2006.01)

(52) U.S. Cl.
USPC ..... 52/506.06; 52/506.07; 52/506.09; 403/293

(58) Field of Classification Search
USPC ..... 52/280, 287, 288, 716.1, 716.01, 52/717.06, 718.01, 506.06, 506.07, 52/506.09; 403/295, 298, 293
See application file for complete search history.

(56) References Cited

U.S. PATENT DOCUMENTS

| | | | | | |
|---|---|---|---|---|---|
| 2,217,574 | A | * | 10/1940 | Tinnerman | 52/718.06 |
| 2,399,785 | A | * | 5/1946 | Blickensderfer et al. | 52/643 |
| 3,180,457 | A | * | 4/1965 | Bohnsack | 52/220.7 |
| 3,742,668 | A | * | 7/1973 | Oliver | 52/288.1 |
| 3,823,251 | A | * | 7/1974 | Heithecker et al. | 174/498 |
| 4,422,609 | A | * | 12/1983 | Clark | 248/228.1 |
| 4,642,957 | A | * | 2/1987 | Edwards | 52/242 |
| 4,725,083 | A | * | 2/1988 | Schauer | 285/405 |
| 4,850,172 | A | * | 7/1989 | Gailey et al. | 52/665 |

(Continued)

FOREIGN PATENT DOCUMENTS

| | | |
|---|---|---|
| EP | 1132541 A2 | 9/2001 |
| FR | 2541708 A1 | 8/1984 |

OTHER PUBLICATIONS

International Search Report and Written Opinion of the International Searching Authority dated Jun. 13, 2013 for corresponding International Application No. PCT/US2013/027854, filed Feb. 27, 2013.

*Primary Examiner* — Basil Katcheves
*Assistant Examiner* — Joshua Ihezie
(74) *Attorney, Agent, or Firm* — Pearne & Gordon LLP

(57) ABSTRACT

A splice plate for joining and aligning extruded trim strips used in suspended ceiling islands and fascias of the type having a pair of opposed flanged channels on its rear face, the splice plate having upper and lower flanges proportioned to slide into the pair of channels and a pair of clamping elements, each of the clamping elements being disposed in a rearwardly horizontally spaced relation to a respective one of said splice plate flanges, a machine screw associated with each clamping element and arranged when turned to draw the respective clamping element forcibly towards an associated plate flange to thereby clamp an intervening portion of a trim channel flange, said plate being sufficiently long to span between a pair of end abutted trim strips.

9 Claims, 2 Drawing Sheets

(56) References Cited

U.S. PATENT DOCUMENTS

| | | | | | |
|---|---|---|---|---|---|
| 4,918,886 | A | * | 4/1990 | Benoit et al. | 174/497 |
| 5,003,743 | A | * | 4/1991 | Bifano et al. | 52/288.1 |
| 5,154,031 | A | * | 10/1992 | Wall | 52/506.06 |
| 5,195,289 | A | * | 3/1993 | LaLonde et al. | 52/506.06 |
| 5,309,686 | A | * | 5/1994 | Underwood et al. | 52/29 |
| 5,313,759 | A | * | 5/1994 | Chase, III | 52/506.06 |
| 5,350,227 | A | * | 9/1994 | Katz | 312/198 |
| 5,359,817 | A | * | 11/1994 | Fulton | 52/288.1 |
| 5,426,901 | A | * | 6/1995 | Indracek | 52/288.1 |
| 5,572,844 | A | * | 11/1996 | Stackenwalt et al. | 52/506.07 |
| 5,732,747 | A | * | 3/1998 | Holliday | 138/163 |
| 5,740,642 | A | * | 4/1998 | Koenig et al. | 52/255 |
| 5,743,063 | A | * | 4/1998 | Boozer | 52/713 |
| 5,813,179 | A | * | 9/1998 | Koenig et al. | 52/255 |
| 5,937,605 | A | * | 8/1999 | Wendt | 52/506.06 |
| 6,018,923 | A | * | 2/2000 | Wendt | 52/712 |
| 6,138,425 | A | * | 10/2000 | Wendt | 52/506.07 |
| 6,141,926 | A | * | 11/2000 | Rossiter et al. | 52/239 |
| 6,305,139 | B1 | * | 10/2001 | Sauer | 52/506.07 |
| 6,763,641 | B1 | * | 7/2004 | Ahren et al. | 52/506.06 |
| 7,788,872 | B2 | * | 9/2010 | Platt | 52/665 |
| 8,006,454 | B2 | * | 8/2011 | Jankovec et al. | 52/506.07 |
| 8,522,498 | B2 | * | 9/2013 | Picken | 52/287.1 |
| 8,534,016 | B2 | * | 9/2013 | DePaul | 52/288.1 |
| 2003/0177735 | A1 | * | 9/2003 | Seeba et al. | 52/726.2 |
| 2005/0034410 | A1 | * | 2/2005 | Stackenwalt | 52/716.1 |
| 2006/0102883 | A1 | * | 5/2006 | Troutman et al. | 256/13.1 |
| 2009/0293403 | A1 | * | 12/2009 | Cedrone et al. | 52/506.06 |
| 2013/0180202 | A1 | * | 7/2013 | Woods et al. | 52/710 |

* cited by examiner

SPLICE CLIP FOR CEILING GRID SYSTEMS

This application claims the benefit of U.S. provisional patent application Ser. No. 61/605,468, filed Mar. 1, 2012.

The invention relates to a splice clip for ceiling grid systems.

BACKGROUND OF THE INVENTION

The invention relates to suspended ceiling island and fascia construction and, more particularly, to a splice for perimeter trim used in such construction.

PRIOR ART

In commercial architecture, a type of perimeter trim is available for constructing suspended island ceilings and fascias. This trim is available in lengths of extruded aluminum with several face height options. Typically, the trim visible face is flat while its rear face, which is ordinarily concealed in use, has one or more extruded tracks each in the form of two opposed grooves, that are used for attaching the trim to a suspended grid and for receiving splice plates for joining the ends of the trim.

Typically, a splice plate is assembled in the tracks at the ends of two trim pieces to be joined so that the plate bridges the joint. The splice plate serves to lock the abutting trim pieces together and aligns the visible faces of the abutting trim pieces, both vertically and horizontally and, in the case of corners, keeps the trim in a tight vertically registered joint.

Some prior art splice plates use set screws to secure the splice plate to the trim strips. Where the set screw bears directly against the vertical main wall of the trim strip that forms the appearance face, there is a risk that the trim strip will be dented if the set screw is over-tightened and the appearance face will be permanently blemished.

SUMMARY OF THE INVENTION

The invention provides a splice plate for suspended ceiling trim strips that can be effectively used in end joints with straight and/or curved trim strips as well as in joints at inside and outside corners. The disclosed splice plate is a unitary body, apart from clamping screws, that is preferably stamped from metal sheet stock. The splice plate is configured to clamp only areas of the bracket/splice receiving track on the rear side of the trim. This manner of clamping avoids any risk of damage to the appearance side of the trim.

The disclosed splice plate is segmented and otherwise configured with weakened lines to facilitate its use with curved trim strips and at both inside and outside corners.

DESCRIPTION OF THE PREFERRED EMBODIMENT

Figure 1:
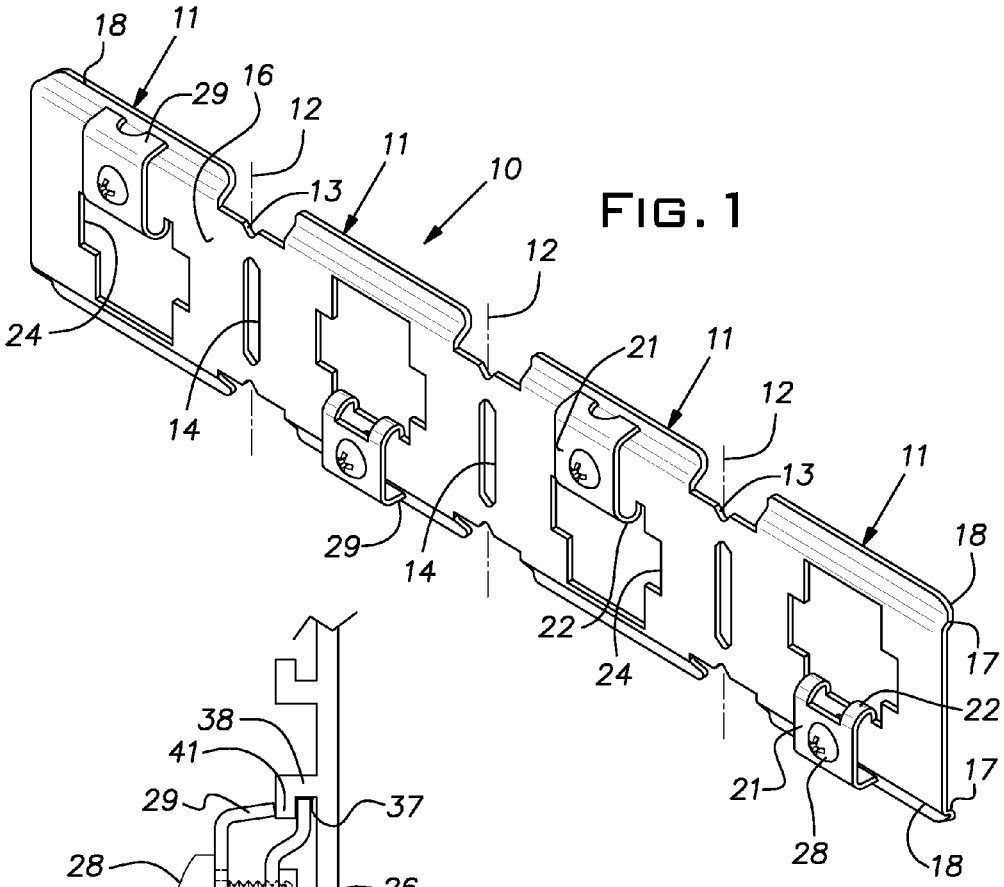
FIG. 1 is an isometric view of a splice plate embodying the invention.
Figure 2:
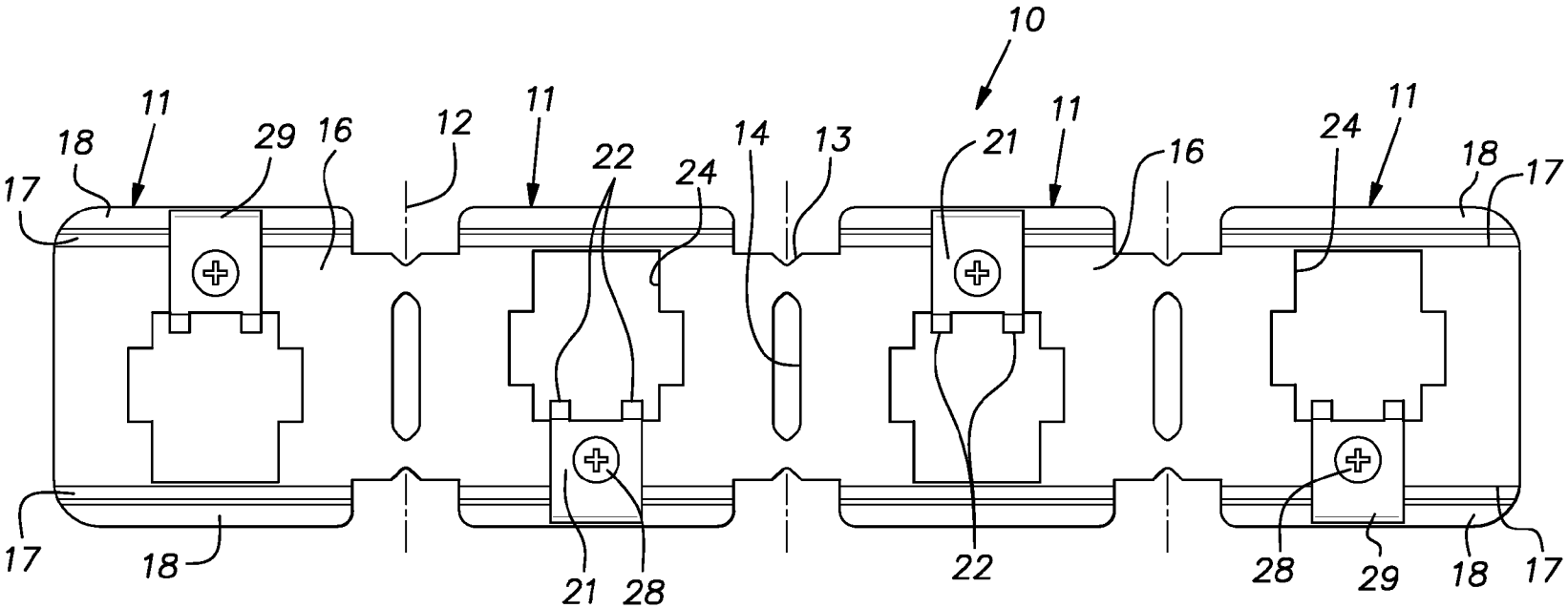
FIG. 2 is a rear elevational view of the splice plate of FIG. 1.

Referring now to the figures, there is shown a splice plate 10 formed by stamping sheet metal in the illustrated configuration. By way of example, the splice plate 10 can be 19 gauge galvanized steel. The figures illustrate the splice plate 10 in an upright orientation in which it is normally used. The splice plate 10 is an elongated body which in the illustrated example, is about 7⅔ inches long and about 1⅝ inches high. The splice plate 10 has four substantially identical integral sections 11, each section being joined at a bend line 12 formed by opposed peripheral notches 13 and an intervening elongate vertical through slot 14. The notch 13 and slot 14 locally weaken the body of the splice plate 10 so that the plate can be bent on a line or lines 12 out of the plane in which it is shown in FIGS. 1 and 2. Each section 11 is inverted from its adjacent section or sections. A mid-portion 16 of each section 11 is generally planar. At an upper margin of the mid-portion 16, there is an upwardly and forwardly inclined web 17 and an offset, generally vertical, upstanding flange 18. Similarly, at a lower margin of the mid-portion 16 are a downwardly and forwardly inclined web 17 and a generally vertically depending flange 18.

An integral tab 21 is blanked out of the center of the mid-portion 16 and is folded back nearly 180 degrees from its original location in the plane of the mid-portion. The tab 21 remains attached with the mid-portion through a pair of spaced straps 22. A hole 24 is left in the central area of the mid-portion 16 after formation of the rearwardly folded tab 21, and straps 22.

An area of the mid-portion 16 that the tab 21 overlies is formed with a drawn and tapped hole 26. The tab 21 has an oversize hole 27 that aligns with the tapped hole 26. A machine screw 28 is assembled from the rear of the splice plate through the tab hole 27 into the tapped hole. The tab 21 includes a flange 29 that lies directly behind the mid-portion flange 18.

Figure 3:
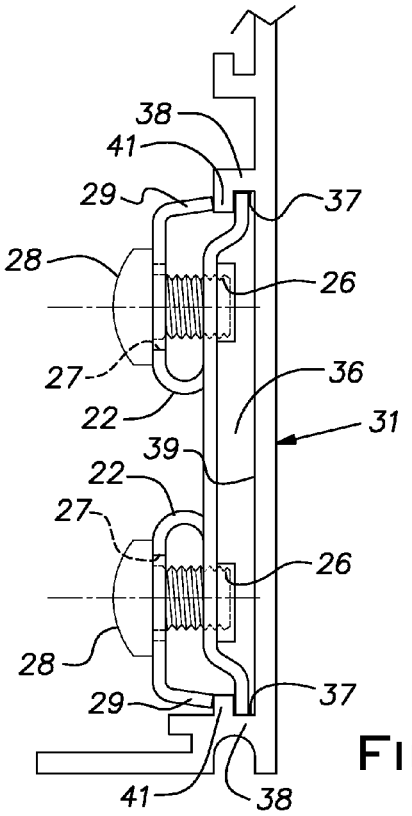
FIG. 3 is an edge view of the splice plate illustrated in relation to a perimeter trim strip shown in a cross-section view in a plane transverse to the length of the trim strip.

FIG. 3 illustrates, in cross-section, an elongated trim strip 31 which is ordinarily an aluminum extrusion with a constant cross-section. Typically, the trim strip 31 is supplied in different heights of, for example, nominally 2, 4, 6, 8, 10 and 12 inches. Conventionally, the shorter (narrower) strips have a single track 36 on their rear face as a part of the extruded cross-section. The track 36 receives clips for connecting the trim strip 31 to a suspended ceiling grid and for receiving splice plates. Taller trim strips, not shown, can have multiple tracks 36 each having the same geometry as that illustrated. The track 36 comprises a pair of opposed grooves 37. Each groove 37 is formed by a web 38 extending perpendicularly from a rear face 39 of the trim strip 31 and a flange 41 distal from the rear face 39 and extending vertically towards a flange 41 of the opposite groove 37.

The splice plate 10 is proportioned so that its flanges 18 fit in the grooves 38 with sufficient vertical and horizontal clearance to enable it to slide freely along a straight length of the trim strip 31. The thickness of the sheet metal forming the splice plate 10 is less than the horizontal width of the grooves 37. The offset of the flanges 18 provided by the web 17 assures that each section 11 is resistant to bending about a vertical axis where the flanges exist. It will be understood that the stiffness contributes to the effectiveness of the splice plate in accurately aligning a pair of abutting trim strip ends.

The splice plate is installed on a trim strip by sliding it into the track 36 from one end of the trim strip. The splice plate 10 may be slid entirely into one trim strip and then pulled back while it is guided into an abutting trim strip end. Alternatively, approximately half the length of the splice plate 10 is slid into one end of a trim strip and the remaining portion is inserted into the other trim strip end to be joined.

Initially, the tab flanges 29 are supplied with a spacing from the section flanges 18 that is somewhat greater than the horizontal thickness of the trim strip track flanges 41. The splice plate 10 is locked in place on a trim strip 31 by tightening the machine screws 28. When a screw 28 is turned into the hole 26, the tab flange 29 is drawn towards the associated section flange 18. The screw 28, bringing the flanges 29, 18 together, results in the track flange 41 of the trim strip 10 being forcibly clamped or pinched. When all of the machine screws 28 are tightened, both abutting ends of joined trim strips 31 are locked in position relative to one another. The splice plate 10, additionally, precisely aligns the appearance or front faces of the abutted trim strips 31.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A splice plate for joining and aligning extruded trim strips used in suspended ceiling islands and fascias of the type having a pair of opposed flanged channels on its rear face, the splice plate having upper and lower flanges lying in a common vertical plane and proportioned to slide into the pair of channels and a pair of clamping elements stamped out of a central area of the splice plate, each of the clamping elements being disposed in a rearwardly horizontally spaced relation to a respective one of said splice plate flanges, a separate machine screw passing successively through each clamping element and the splice plate and arranged when turned to draw the respective clamping element forcibly towards an associated splice plate flange to thereby clamp an intervening portion of a trim channel flange, said splice plate being sufficiently long to span between a pair of end abutted trim strips.

2. A splice plate as set forth in claim 1, being stamped from sheet metal.

3. A splice plate as set forth in claim 2, wherein the clamping elements are folded through an angle approaching 180 degrees and lie rearwardly of an associated one of said plate flanges.

4. A splice plate as set forth in claim 3, wherein each machine screw is assembled through a hole in an associated one of said clamping elements and threaded into a main part of the splice plate.

5. A splice plate as set forth in claim 4, wherein said clamping elements lie rearwardly of the trim channel flange.

6. A splice plate as set forth in claim 1, including a plurality of clamping elements distributed along the length of the splice plate.

7. A splice plate as set forth in claim 6, including two upper clamping elements and two lower clamping elements.

8. A splice plate as set forth in claim 7, wherein the upper and lower clamping elements alternate along the length of the splice plate.

9. A splice plate as set forth in claim 1, wherein said clamping elements include feet preventing over-tightening distortion of said clamping elements in the event of a respective screw being excessively tightened.

* * * * *